United States Patent [19]

Huffman

[11] 4,421,456

[45] Dec. 20, 1983

[54] CENTRIFUGAL PUMP ASSEMBLY

[75] Inventor: Robert R. Huffman, Houston, Tex.

[73] Assignee: C T Manufacturing, Inc., Houston, Tex.

[21] Appl. No.: 401,659

[22] Filed: Jul. 26, 1982

Related U.S. Application Data

[63] Continuation-in-part of Ser. No. 357,993, Mar. 15, 1982.

[51] Int. Cl.[3] ..... F01D 11/00

[52] U.S. Cl. ..... 415/170 A; 415/170 R; 308/236; 308/191; 308/187.1; 308/189 R

[58] Field of Search ..... 415/170 A, 170 R; 308/236, 191, 187.1, 189 R

[56] References Cited

U.S. PATENT DOCUMENTS

| | | | |
|---|---|---|---|
| 336,807 | 2/1886 | Hawley | 384/132 |
| 500,899 | 7/1893 | Holmes | 277/66 |
| 775,193 | 11/1904 | Rollins | 277/44 |
| 905,103 | 11/1908 | Rollins | 277/66 |
| 1,013,317 | 1/1912 | Samuelson | 415/117 |
| 2,049,774 | 8/1936 | Hoffman | 277/62 |
| 2,190,670 | 2/1940 | Mann | 415/128 |
| 2,394,012 | 2/1946 | Rayburn | 277/94 |
| 3,485,178 | 12/1969 | Dutton et al. | 415/170 A |
| 3,551,067 | 12/1970 | Wissman | 415/204 |
| 3,632,220 | 1/1972 | Lansinger | 415/170 A |
| 3,976,341 | 8/1976 | Colley | 308/187.1 |

OTHER PUBLICATIONS

MCM Centrifugal Pump Brochure.
Harrisburg MCM Centrifugal Pump Brochure.
Mission Magnum I Centrifugal Pump Brochure.

*Primary Examiner*—Stephen Marcus
*Assistant Examiner*—John Kwon
*Attorney, Agent, or Firm*—Vaden, Eickenroht, Thompson, Bednar & Jamison

[57] ABSTRACT

An improved centrifugal pump of the end suction type having a mechanical seal and a ball bearing contained in a unique stuffing box about a rotating impeller shaft. The box positions the bearing close to the impeller and reduces the bending movement of the shaft at the seal in severe services, e.g., pump startup conditions in drilling mud systems. Also, the box is arranged for the ready removal or replacement of the machanical seal or bearing. The pump has a casing defining an annular chamber wherein an impeller is driven by rotatable pump shaft. The box is mounted in a cover secured to the casing. The cover has a concentric central opening providing an annulus about the shaft. The box is seated by step surfaces in the central opening and secured to the cover by bolts. The mechanical seal is mounted about the shaft against an inwardly facing stepped surface within the box. The bearing is releaseably mounted on the shaft and has an external cylindrical surface seated against an outwardly stepped surface in the box.

10 Claims, 2 Drawing Figures

CENTRIFUGAL PUMP ASSEMBLY

RELATED APPLICATION

This application is a continuation-in-part of my copending application Ser. No. 357,993 filed on Mar. 15, 1982 and entitled "Centrifugal Pump Assembly.

BACKGROUND OF THE INVENTION

1. Field of the Invention

This invention relates to centrifugal pumps of the type employing mechanical seals.

2. Description of Prior Art

Centrifugal pumps are useful machines found in every day applications and especially in industry for moving many types of fluids, including those of a gel type or high particulate content. The centrifugal pump may have a casing defining an annular chamber with fluid inlet and outlet. An impeller rotated by a pump shaft is positioned in the chamber. Upon rotation of the impeller, fluid is moved through the chamber between the inlet and outlet. The pump shaft, as a rotatable member, is sealed in substantial fluid tightness to a wall member which closes one side of the chamber adjacent to the impeller.

In some situations, mechanical seals are used in centrifugal pumps when it becomes impractical to use conventional packing and sealing rings with radial sealing surfaces. In mechanical seals, the sealing surfaces are located in a plane perpendicular to the pump shaft. These sealing surfaces are highly polished and run upon each other with one surface carried by the shaft and the other surface on the pump's body. A spring urges these sealing surfaces into contact with only a thin film of liquid between them. Usually, the mechanical seal (single or double set) are mounted inside of a stuffing box to provide a usable seal assembly.

Mechanical seals will leak excessively if the pump shaft is laterally deflected so that the polished sealing surfaces are moved from the plane perpendicular to the pump shaft. In prior art pumps, the shaft deflection by bending was reduced by increased shaft strength and by placing the shaft bearings as close to the stuffing box as possible. However, many pump designs cannot be reconstructed to accommodate larger shafts or complex bearings, especially as retrofits on existing pumps having large volume production runs, or for other reasons.

Centrifugal pumps used in certain services require mechanical seals, and the fluid being handled has properties that create severe pump shaft bending moments. For example, the centrifugal pumps used for moving liquids loaded with solids such as rocks, sand or semisolids such as drilling mud (a non-newtonian fluid having thioxotropic properties) produce severe offcenter impeller loading on start-up of the pump. As a result, even shafts of one and one half inches in diameter can be flexed or bent adjacent the impeller of nearly one eighth of an inch in lateral deflection. Usually, a pump shaft deflection of greater than four to six thousandths of an inch will cause leakage or injury to a mechanical seal. An explanation of these severe bending problems of pump shafts resides in the settling of solids about the lower side of the impeller. Then, start-up of the pump produces severe flexing of the pump shaft before the impeller rotates sufficiently to clear its chamber of solids or solids like properties in drilling muds.

The present invention provides an improved centrifugal pump with a unique stuffing box assembly such that the remainder of the pump can be of conventional design. This stuffing box provides close mounting to the impeller of the mechanical seal and an antifriction (e.g. ball) bearing so as to reduce pump shaft flexing to a minimum amount tolerated by the mechanical seals. Further, the design of the stuffing box provides for a relatively simple pump structure to manufacture and easily employed for renewing the bearings or seals.

SUMMARY OF THE INVENTION

In accordance with this invention, there is provided an improvement in the stuffing box arrangement in a centrifugal pump of the end suction pump type. The pump has a casing defining an annular chamber connected with inlet and outlet fluid means. An impeller mounted upon a rotational pump shaft is positioned within a chamber and sealed by a conventional pedestal cover secured to the casing. The cover has a central opening providing an annulus located concentrically with the shaft. A removable stuffing box is seated by step surfaces in this central opening and releaseably secured to the cover by bolting or the like. The stuffing box has a cylindrical passageway concentric with the rotational axis of the shaft. Mechanical sealing members are mounted about the shaft against an inwardly facing step surface within the central passageway. An antifriction bearing is slideably mounted on the shaft and has an external cylindrical surface adapted to seat within an outwardly facing stepped surface within the cylindrical passageway. Locking means secure the bearing in fixed operative position onto the shaft.

DESCRIPTION OF THE DRAWINGS

In these drawings, the several figures have like elements, and these elements will carry like numerals to simplify the description of the improved centrifugal pump.

DESCRIPTION OF PREFERRED EMBODIMENTS

Figure 1:
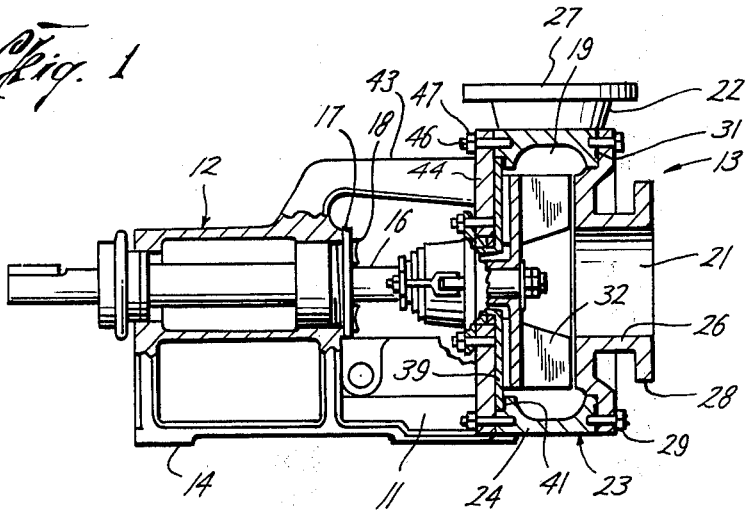
FIG. 1 is a pictorial view, partially in section, illustrating one embodiment of the improved centrifugal pump arranged according to the present invention.

Referring to FIG. 1, there is shown an improved centrifugal pump arranged with the novel stuffing box arrangement of the present invention. Although the centrifugal pump 11 is shown as a single end suction, radial flow type, the improved stuffing box arrangement can be utilized on other types of centrifugal pumps such as the double suction, axial flow or multi-stage types.

The pump 11 has a journal or bearing housing 12, and a fluid end 13 mounted integrally upon a common base 14 which rests upon a supporting surface during operation of the pump. The bearing housing 12 provides for the rotatable mounting of a pump shaft 16 which extends from a prime mover (not shown) through the bearing housing 12 and into the fluid end 13 of the pump. In some instances, a prime mover, such as an electric motor, may be substituted for the bearing housing 12 in small pump types, or for other reasons. Where a bearing housing 12 is employed, it may terminate on the side facing the fluid end with a bearing cap 17 held in place by a cap nut 18.

The pump shaft 16 extends into the fluid end 13 and more particularly terminates within an annular chamber 19 which is in fluid communication with an inlet 21 and an outlet 22. In the type of pump shown in FIG. 1, the chamber 19 is provided by a casing 23 which can be monolithic, but preferably, it is comprised of an impeller housing in the form of a casing ring 24 and a face housing or casing 26. The casing ring 24 is provided with a flange 27 for connecting the outlet 22 to a suitable discharge system whereas the face casing 26 can be provided with a flange 28 for connecting the inlet 21 to a suitable source of fluid to be moved by the pump 11. Usually, the face casing 26 is secured in fluid tight mounting upon the casing ring 24 by a plurality of cap screws 29 in conjunction with a gasket 31. An impeller 32 is mounted upon the threaded end 33 of the shaft 16 by jam nuts 34 in conjunction with a key 40 and a locking washer 36 that force the impeller hub 37 against a shoulder 38 formed on the reduced diameter end of the pump shaft 16. As a result, the impeller 32 is mounted for rotation within the chamber 19 and for moving fluid from the inlet 21 to the outlet 22 at a suitable pressure within the desired parameters of the pump 11. The side of the impeller 32, opposite the inlet 21, is sealed by a conventional wearplate 39 that is held within an annular recess formed within the casing ring 24 and sealed thereto by a gasket 41. The wearplate has a cylindrical extension 42 along the shaft 16.

The fluid end of the pump 32 is mounted integrally to the bearing housing 12 by a pedestal 43 that can be integrally formed with the base 14. The pedestal 43 carries a disc-like pedestal cover 44 that is transverse to the axis of rotation of the shaft 16. The cover 44 is integrally secured to the wear plate 39 and the casing ring 24 by a plurality of studs 46 upon which are threaded nuts 47. As a result, this conventional arrangement of the fluid end 13 permits ready access to the chamber 19 by removal of the nuts 47 or the cap screws 29 depending upon which side of the impeller 32 is desired to be exposed. It will be apparent the fluid end 13 of the pump 11 has conventional parts. Obviously, other arrangements of the fluid end 13 can be employed with the unique stuffing box arrangement now to be described.

The stuffing box assembly 51 is comprised of a stuffing box 52 which is arranged to cooperate with the cover 44 and the extension 42 of the wearplate 39 to prevent undesired leakage of fluids from the chamber 19 along the shaft 16. For this purpose, a resilient sealing ring 53 is carried in an annular groove about the extension 42 and it provides a fluid tight seal to the stuffing box along its cylindrical passageway 54.

The stuffing box 52 is releaseably mounted to the cover 44 in a manner to provide self centering about the shaft 16. For this purpose, a central opening is provided the cover 44 and defined by a cylindrical internal wall 56. The wall 56 is concentric with the rotational axis of the shaft 16. A circular flange 57 extends radially outwardly from the shaft 16 and connects to a cylindrical projection 58 that defines stepped surfaces 59 and 61 upon the stuffing box 52. These surfaces 59 and 61, respectively, seat upon the flat face 62 and cylindrical wall 56 of the cover 44. Thus, the stuffing box 52 by these surfaces is always aligned concentric as to passageway 54 with respect to the axis of rotation of the shaft 16 in its releasable mounting within the cover 44. In addition, the step surface 61 seats about the projection 42 upon the wear plate 39. A wear ring 63 may be employed between the projection on the stuffing box 52 and the presented face of the wear plate 39 to insure its proper structural and operational mounting to the cover 44.

The stuffing box 52 is releaseably secured to the cover 44 by a plurality of studs 64 which pass through openings 66 in the flange 57 and retained by nuts 67. Removal of the nuts 67 from the studs 64 allows an easy removal of the stuffing box axially away from the cover 44. If desired, a beveled surface 68 may be provided upon the flange 57 to permit the insertion of a pry bar or the like to assist in moving the stuffing box 52 away from the cover 44.

Figure 2:
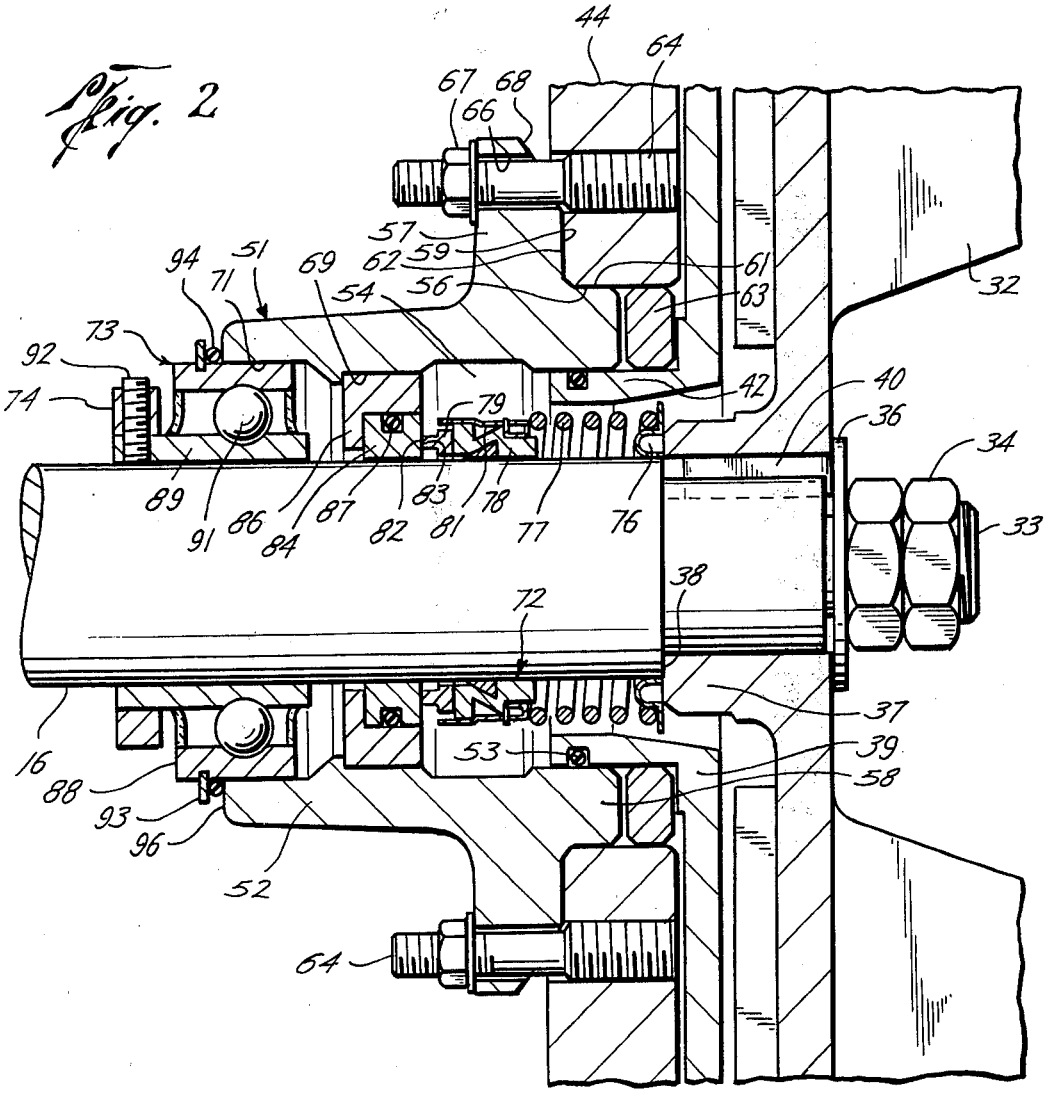
FIG. 2 is an enlarged vertical section taken through the fluid end of the pump of FIG. 1.

Referring now to FIG. 2, the specific construction of the stuffing box 52 can be readily seen. The stuffing box 52 has the internal cylindrical passageway 54 provided with an inwardly facing step surface 69 and an outwardly facing step surface 71. A mechanical seal 72 is mounted about the shaft 16 between the surface 69 and the impeller 32. An antifriction bearing, preferably a ball bearing 73 is mounted about the shaft 16 between the surface 71 and an exterior locking ring 74.

More particularly, the seal 72 may be conventional of the single stage, automatic packing type having a cup 76 seated against the impeller with a biasing spring 77 forcing an annular follower 78 against a rotary sealing ring 79. A wire cage 81 may be provided the follower 78 to maintain dynamic alignment with the ring 79. The ring 79 can be made of carbon although other materials such as Teflon polymer can be used. The ring 79 has a polished surface 82 in a plane normal to the axis of the shaft 16, and this surface 82 rides upon a similar polished surface 83 upon a wear ring 84 seated in an annular metal housing ring 86 and sealed fluid tight by an annular resilient seal 87.

The bearing 73 is preferably of the sealed ball bearing type to absorb dynamically both lateral and radial loading stresses. For this purpose, the bearing has an exterior ring 88 that seats within the stepped surface 71 on the stuffing box 82. The carrier ring 89 telescopes over the shaft 16 with the balls 91 held captive in annular grooves between the rings 88 and 89.

The bearing 73 is held securely in place relative to the shaft 16 and stuffing box 52 by the locking ring 74 which can include a set screw 92 that may pass through the ring 89 and tightly seat against the shaft 16. As a result, the bearing 73 is closely mounted adjacent the mechanical seal 72 and readily prevents the forces on the impeller 32 from bending the shaft sufficiently to cause leakage or injury to the seal 72. Stated in another manner, the bearing 73 is closely coupled to the seal 72 along the shaft 16 whereby the bending forces in operation of the pump 11 are insufficient to laterally deflect the mechanical seal 72 and cause the problem hereafter experienced. Good results are obtained when the bearing 73 is not over about three shaft diameters from the impeller 32 in its mounting in the stuffing box 52.

With the present arrangement of the stuffing box 52, the seals 72 or bearing 73 are readily exposed for servicing or replacement. For example, the seal 72 or the bearing 73 can be easily exposed for inspection, service or replacement. In this regard, the nuts 67 are removed from the studs 64. Also, the set screw 92 is released to free the locking ring 74 from the bearing carrier 89 and shaft 96. Now, the stuffing box 51 can be slid axially along the shaft 16 away from the cover 44. With the seal 72 exposed, it can be inspected or serviced or defective parts (split ring types) replaced. If the wear ring 84 is to be removed or replaced, the bearing 73 is pulled axially from the stepped surface 71 a sufficient distance that the wear ring 84 can be pushed from its mounting in the housing ring 86. After any servicing or replacement of parts are completed, the stuffing box 51 is rebolted to the cover 44 and the locking ring 74 and set screw 92 are secured to the shaft 16.

Alternatively, the seal 72 can be serviced or replaced by removing the casing ring 24 from the pedestal 43. Then, the nuts 34 are unscrewed and the impeller 32 removed from the shaft 16 at its end 33. Now, the seal 72 can be slid from the shaft 16. The wear ring 84 and housing ring 86 can also be removed as previously described.

After replacing the parts of the seal 72, the pump 11 is reassembled.

A snap ring 93 can be received in a groove with the cylindrical ring 88 with a resilient seal ring 94 compressed against the end face 96 of the box 59. As a result, relative movements between the shaft 16 and the box 52 can be accommodated while yet providing a fluid seal between these members.

It will be apparent that the improved pump 11 provides not only a close coupling of the mechanical seal and the antifriction bearing relative to the impeller so that pump shaft bending is strongly resisted, but the placement of the bearing and seal is in a unique removable stuffing box that greatly simplifies inspection, servicing or repairing operations.

From the foregoing, it will be apparent that there has been provided a centrifugal pump with a novel stuffing box assembly that provides many advantages when mechanical seals are employed in solids ladened fluids, such as drilling muds. It will be appreciated that certain changes or alterations in the present improved centrifugal pump may be made without departing from the spirit of this invention. These changes are contemplated by and are within the scope of the appended claims which define the invention. Additionally, the present description is intended to be taken as an illustration of this invention.

What is claimed is:

1. In a centrifugal pump of the end suction type and having casing means defining an annular chamber, a rotatable pump shaft in the chamber and aligned with the fluid inlet, an impeller mounted by a threaded nut at the end of the pump shaft within the chamber and a shaft mounting structure including a pedestal cover secured to the casing, the improvement comprising:

(a) said cover having a central opening providing an annulus located concentrically with said shaft;

(b) a removable bearing and seal carrying stuffing box seated by stepped surfaces in said central opening and releasably secured to said pedestal cover;

(c) said box having a cylindrical passageway concentric with the rotational axis of said shaft and said passageway having outwardly and inwardly facing step surfaces;

(d) a mechanical sealing member mounted against said inwardly facing step surface about said shaft within said cylindrical passageway of said box;

(e) an antifriction bearing mounted against said outwardly facing step surface on said shaft and having an external cylindrical surface adapted to seat within said outwardly facing step surface within said cylindrical passageway of said box thereby restraining lateral shaft deflections; and (f) locking means for securing said bearing in fixed operative position onto said shaft;

whereby said box can be released from said cover and moved axially along said shaft to facilitate removal and replacement of said bearing and said mechanical sealing member.

2. The improved pump of claim 1 wherein said bearing is mounted within said box not over three shaft diameters from said impeller on said shaft.

3. The improved pump of claim 1 wherein an external cylindrical surface of said bearing is exposed from said box and said surface carries an annular groove to secure a locking ring for compressing an annular resilient sealing ring between said surface and said box.

4. The improved pump of claim 1 wherein said box after being released from said cover can be slid axially along said shaft a certain distance from said cover, said certain distance permitting said bearing to be slid in one direction on said shaft from said box and said sealing member slid in an opposite direction on said shaft from said box to eject substantially all of said sealing member from said cylindrical passageway of said box.

5. The improved pump of claim 1 wherein said sealing members in said cylindrical passageway are held at their ends by an annular wear ring and a circular cup seated against the end of said impeller.

6. The improved pump of claim 1 wherein said box has a tubular body with a flange extending radially outwardly between the ends of said body thereby forming said stepped surfaces, and said flange carrying a plurality of openings adapted to receive bolting means for securing said box to said cover on its side away from said impeller.

7. The improved pump of claim 1 wherein said box has a tubular body with a flange extending radially at one end of said body thereby forming said stepped surfaces and said central opening carrying complementary stepped surfaces whereby said box is slideably seated into said cover.

8. The improved pump of claim 7 wherein said flange carries a plurality of openings adapted to receive bolting means for securing said box to said cover.

9. The improved pump of claim 1 wherein a wear plate is secured in fluid tight relationship between said cover and said casing, and said wear plate has a circular end positioned about said pump shaft, and said circular end has an exterior surface with an annular seal for holding and sealing said wear plate to said cover and said box.

10. The improved pump of claim 1 wherein said antifriction bearing is a ball bearing having a cylindrical ring held in said box against said outwardly facing stepped surfaces and a cylindrical carrier slideably mounted upon said shaft and secured thereto by a locking ring including a set screw.

* * * * *